US012643136B2

(12) United States Patent
Menon et al.

(10) Patent No.: US 12,643,136 B2
(45) Date of Patent: Jun. 2, 2026

(54) DYNAMIC ROLL ECCENTRICITY IDENTIFICATION USING EXTENDED KALMAN FILTER STATE ESTIMATION AND CONTROL UPGRADE FOR COLD ROLLING MILLS

(71) Applicant: Honeywell International Inc., Charlotte, NC (US)

(72) Inventors: Archana Menon, Bengaluru (IN); Dattaraj Bhat, Bengaluru (IN); Shailendra Kumar Gupta, Bengaluru (IN)

(73) Assignee: HONEYWELL INTERNATIONAL, INC., Charlotte, NC (US)

( * ) Notice: Subject to any disclaimer, the term of this patent is extended or adjusted under 35 U.S.C. 154(b) by 542 days.

(21) Appl. No.: 18/120,343

(22) Filed: Mar. 10, 2023

(65) Prior Publication Data

US 2024/0299997 A1 Sep. 12, 2024

(51) Int. Cl.
*G05B 19/4155* (2006.01)
*A43D 8/02* (2006.01)
(Continued)

(52) U.S. Cl.
CPC ..... *B21B 37/66* (2013.01); *B21B 37/18* (2013.01); *B21B 37/28* (2013.01); *B21B 37/60* (2013.01); *B21B 38/04* (2013.01); *B21B 38/08* (2013.01)

(58) Field of Classification Search
CPC ..... B21B 37/66; B21B 37/18; B21B 37/28; B21B 37/60; B21B 38/04; B21B 38/08;
(Continued)

(56) References Cited

U.S. PATENT DOCUMENTS 3,881,335 A 5/1975 Cook
3,882,705 A 5/1975 Fox
(Continued)

FOREIGN PATENT DOCUMENTS

JP H01245909 A * 10/1989
JP 2018176275 A 11/2018

OTHER PUBLICATIONS

Radionov, A.A., Gasiyarov V.R., Karandaev A.S., Loginov B.M., and Khramshin V.R., "Improving the mechatronic system for automatic control of the reversing stands of mill 5000," IOP Conference Series: Materials Science and Engineering, vol. 635, No. 1, 2019, doi: 10.1088/1757-899X/635/1/012019 (Year: 2019).*
(Continued)

*Primary Examiner* — Robert E Fennema
*Assistant Examiner* — Magdalena I Kossek
(74) *Attorney, Agent, or Firm* — Seager, Tufte & Wickhem, LLP

(57) ABSTRACT

Control system for cold rolling mills to improve sheet metal thickness uniformity. Sensors monitor the state of the cold rolling mill by measuring (i) roll eccentricity, (ii) roll slips during mill operation, (iii) mill disturbances from roll speed or roll force manifestations, and (iv) unknown disturbances referred to as process noise. The controller analyzes data from sensors to compensate. Data collected during the mill operation by the sensors are delayed in reaching the controller. This communication delay is accounted for by using a filter. Since an objective of the controller software is dynamic identification of eccentricity of the back up rolls, which is non-linear by nature, an Extended Kalman Filter may be used.

16 Claims, 5 Drawing Sheets

(51) Int. Cl.

| | |
|---|---|
| ***B21B 37/18*** | (2006.01) |
| ***B21B 37/28*** | (2006.01) |
| ***B21B 37/60*** | (2006.01) |
| ***B21B 37/66*** | (2006.01) |
| ***B21B 38/04*** | (2006.01) |
| ***B21B 38/08*** | (2006.01) |

(58) Field of Classification Search

CPC ..... B21B 37/58; B21B 2001/221; B21B 2261/04; B21B 37/165; B21B 2265/12; B21B 2275/04; B21B 2275/05; B21B 2275/06; B21B 38/00; B21B 1/22; B21B 37/00; B21B 37/16; B21B 2038/004; B21B 37/20; G05D 5/03

See application file for complete search history.

(56) References Cited

U.S. PATENT DOCUMENTS

| | | | | |
|---|---|---|---|---|
| 4,580,224 | A | 4/1986 | Gerber | |
| 4,691,547 | A * | 9/1987 | Teoh | B21B 37/66 72/10.7 |
| 5,077,997 | A | 1/1992 | Wolters | |
| 6,263,714 | B1 | 7/2001 | Johnson | |
| 6,286,348 | B1 | 9/2001 | Sekiguchi et al. | |
| 2005/0155402 | A1 | 7/2005 | Jeon | |
| 2007/0043533 | A1* | 2/2007 | Wiles | G01M 13/025 702/183 |
| 2009/0138102 | A1 | 5/2009 | Moden | |
| 2009/0210085 | A1 | 8/2009 | Hofbauer et al. | |
| 2013/0213103 | A1* | 8/2013 | Imanari | B21B 37/18 72/7.1 |
| 2016/0059735 | A1* | 3/2016 | Vovos | B60L 50/62 701/22 |
| 2018/0161839 | A1* | 6/2018 | McGahan | B21B 37/58 |
| 2018/0345341 | A1* | 12/2018 | McGahan | B21B 37/62 |

OTHER PUBLICATIONS

Knechtelsdorfer U, Müller M, Steinboeck, Kugi A, "Slip Model Adaptation Based on Measurements of the Strip Velocity," IFAC—PapersOnLine, vol. 52, No. 14, 2019, pp. 42-47. doi: 10.1016/j.ifacol.2019.09.161 (Year: 2019).*

English Machine Translation of JPH01245909A, pp. 1-12 (Year: 1989).*

Kugi, Andreas. "Hydraulic Drive Systems." Non-Linear Control Based on Physical Models. Lecture Notes in Control and Information Sciences, vol. 260, Springer, London, 2001, pp. 121-162. doi: 10.1007/BFb0110344 (Year: 2001).*

Extended European Search Report, EP Application No. 24157613.1, European Patent Office, Aug. 16, 2024 (8 pages).

Odonde, J., "Industrial Application of the Frequency-Doman Aspects of the Kalman Filter," Transactions of the Institute of Measurement and Control, Institute of Measurement and Control, Dorking, GB, vol. 9, No. 1, Jan. 1, 1987, pp. 13-19.

JP Notice of Reasons for Rejection, JP Application No. 2024-016314, Japanese Patent Office, Mar. 26, 2025 (9 pages) (machine translation).

* cited by examiner

DYNAMIC ROLL ECCENTRICITY IDENTIFICATION USING EXTENDED KALMAN FILTER STATE ESTIMATION AND CONTROL UPGRADE FOR COLD ROLLING MILLS

FIELD OF THE INVENTION

The present invention relates, generally, to reducing thickness of sheet material in cold rolling mill systems and, more particularly, to techniques for enhancing the performance of cold rolling mills by dynamic identification of roll eccentricity and compensation.

BACKGROUND OF THE INVENTION

In cold rolling, a sheet of metal material is reduced in gauge or thickness by passing a metal strip between rolling cylindrical surfaces under pressure. Typically, the rolling mill produces a coil of sheet at a thinner and constant gauge.

A single stand cold rolling mill feeds the material from an unwind reel to a rewind reel. The metal strip is passed between work rolls that are acted upon by back up rolls. A force is applied to at least one of the back up rolls.

The cross-section of the work rolls, back up rolls, unwind reels, and rewind reels may not be perfectly round in circumference due to various reasons. Grinding inaccuracy occurs due to axial deviations between roll barrel and roll neck. Non-uniform thermal expansion may occur. Asymmetrical adjustment of bearing roll shell via drive keys may occur. Thermally induced wear and mechanically induced wear may occur with misalignment or aging.

Structural inconsistencies, such as, roll eccentricity, may result. Each eccentricity may include a base frequency which is the rotary frequency of roll and several harmonic frequencies. The eccentricity frequencies change with roll speed. The eccentricity results in a cyclic disturbance signal manifesting as thickness and tension errors.

Most cold rolling mills involve two back up rolls to engage the outer surfaces of the work rolls, so the eccentricity of both back up rolls causes variations in the exit strip gauge thickness. The variation may be in phase or out of phase. Filtering a single eccentricity may be difficult because a pair of work mills may have similar discontinuities and frequencies.

In cold rolling mills the eccentricity of the back up rolls results in variation in the gauge of the strip being rolled. This is caused by a change in the opening between the work rolls during the processing of the work strip. This problem is becoming more pronounced as the specification for strip thickness from the cold rolling mills becomes more stringent.

Over time, the eccentricity profile changes. Eccentricity cannot be measured directly so it is determined by indirect measurement of thickness profile for different mill speeds.

Due to the variables caused by eccentricity and other surface variations of the back up rolls, cold rolling mills may employ position control or automatic gauge control in the normal system for controlling the cold rolling mill. These systems may compensate for fluctuations in the delivered gauge caused by rotational variations in the back up rolls.

Passive compensation includes avoiding the gaining effect of roll eccentricity in mill stretch compensation loop (or gauge meter loop).

Active compensation includes using supplementary signals for position control to compute roll eccentricity that is counteracted with HGC output.

The eccentricity signal may be identified through indirect measurement using learning algorithm.

Eccentricity information may be identified from roll force and used for fast compensation.

Eccentricity information may be estimated from exit thickness measurement.

However, at higher speeds it may become difficult to compensate roll eccentricities with closed loop control of mass flow and strip tension, especially, with time delay.

SUMMARY OF THE INVENTION

The present invention is based on the development of a control system for cold or hot rolling mills to improve sheet metal thickness uniformity to meet or exceed specifications. Sheet metal thickness deviations from standard requirements may be significantly reduced.

Sensors and gauges may be positioned to attain dynamic feedback of a cold or hot rolling mill by measuring (i) the mill rollers' characteristics, such as, roll eccentricity, (ii) work roll slips during mill operations (iii) mill disturbances from roll speed or roll force manifestations, and (iv) unknown disturbances that may be referred to as process noise, which may be represented as Gaussian white noise.

Roll eccentricity of the back up rolls is an important factor that is not easy to measure. For instance, a cold rolling mill may be equipped with various encoders or proximity sensors configured to measure the angular velocity or position of each of the back up rolls. The frequency of data generated by the various sensors should correspond to at least the controller software's execution frequency. This should ensure some functional accuracy for the inventive control system. In addition, the higher the software execution frequency per rotation of the roller, the more effective the eccentricity compensation becomes.

A controller continually analyzes data from the various sensors to estimate the state of the cold rolling mill and, as appropriate, initiates corrective or compensatory measures through roll gap control. Feedback data collected during the cold rolling mill operation by the sensors or observers may be delayed in reaching the controller software. This may be referred to as communication delay. This delay is accounted for by the software by using a filter such as a Kalman filter. Since one of the objectives of the controller software is identification of eccentricity, which is non-linear by nature, an extended Kalman Filter (EKF) is preferably used.

In a preferred embodiment, the control system features dynamic identification of roll eccentricity based on sensor-based data and compensation using an extended Kalman filter (EKF) based on state estimation using dynamic partial state feedback. This is referred to as partial because unknown mill defects or states may be modified as white noise or process noise. There is no direct feedback on the state or condition of the mill defects. They may be being identified and estimated for the next state of operation, through the next execution frame of the controller's software. The eccentricity identification goes through a rough measurement of the effective difference in the thickness being achieved, with respect to the set point of the roll gap, for the desired sheet thickness. This can be referred as an "initial estimate of thickness inaccuracy." For the roll force, feedback is complemented with the set point/applied roll force through control of the hydraulic screw, which can be referred to as the "effective roll force signal," which is assumed to indirectly reflect the rolling mill's eccentricities, roll slips and other defects. This effective roll force signed is aligned over the above-referenced "initial estimate of thickness inaccuracy" to generate an initial estimate of eccentricity signal over the circumference of the back up rollers. This is refined through EKF-based state estimation of mill state to generate an eccentricity compensation signal. Such a dynamic generation of eccentricity signal over the circumference of the back up roller, during mill operations, adapts to the actual eccentricity changes in the rolling mill over time. The thickness deviations observed in current products in cold rolling mills is in the range of 0.5 to 1.5%.

By implementing embodiments of the present invention, cold rolling mills may achieve an improvement of at least 2 to 5%. The control systems of existing cold rolling mills may be upgraded using the present invention. In addition to computing compensation in response to the determined state of the mill, the sensors may result in tunable process parameters which may be tuned within a certain nominal range. The parameters may be scaled up, or scaled down, in adjusting the level of compensation to achieve desired sheet metal results based on the mill operator's discretion. The identified eccentricity signal may also be scaled for different amplitudes by the operator for effective compensation, which is affected by the frequency of the rollers/mill speed.

The controller of the present invention may be tested as a function of operation of a rolled sheet metal mill. The mill operation may be simulated, such as offline, to test the working and then to deploy the invention in a specific mill of interest. The Extended Kalman Filter parameters may be adjusted as appropriate by operator's discretion of the mill state. The Extended Kalman Filter parameters may be operator tunable by the mill operator according to guidance provided during commissioning the mill. The operator may tune the filter values, but, usually, should not exceed the limits in the guidance. These limits are left to be designed, or otherwise specified, by the commissioning engineer for the mill, based on the state or condition of the mill.

DETAILED DESCRIPTION OF THE PREFERRED EMBODIMENTS

Figure 1:
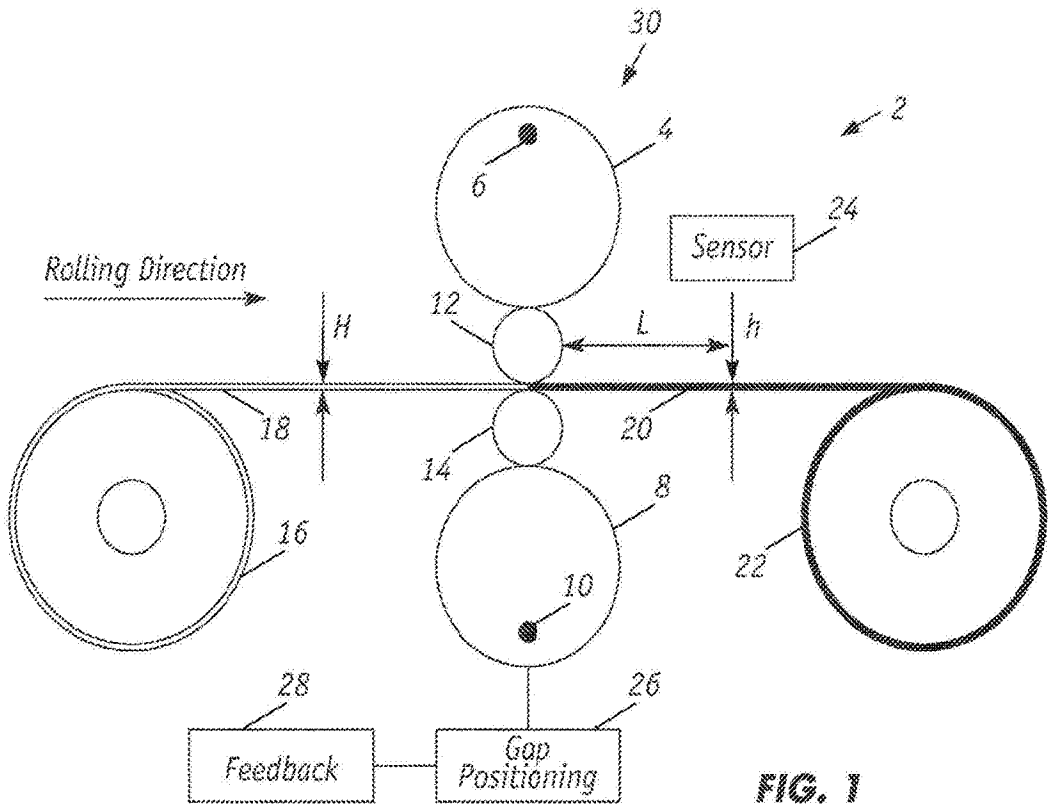
FIG. 1 illustrates a sheet metal cold rolling mill system.

The methods of the present invention include various inventive combinations of the following components:

(1) Dynamic identification of roll eccentricity and compensation for roll eccentricity; (2) Roll slip identification and compensation; (3) Extended Kalman Filter (EKF) based state estimation using dynamic partial state feedback; and (4) Operator tunable parameters to improve estimation of the state of the mill.

As appropriate, mill operators may implement the tunable parameters. The control system of the present invention will be described in controlling the thickness of sheet metal produced in a 4-hi stand cold rolling mill that is taken as a base reference (4-hi-mill). However, it is understood the invention is applicable to various other cold rolling mill arrangements. The description herein assumes that frequency of controller computation and frequency of captured sensor or observer feedback data may be designed and implemented to occur at suitable periodic time intervals deemed effective on the mill operations.

Definitions

As used herein, the following terms have the following meanings.

The term "Work Roll" (WR) refers to a set of rollers that are in contact with the surface of the sheet metal produced.

The term "Back Up Roll" (BUR) refers to a pair of rollers which are used to apply higher pressure on the WRs. The two pairs of rollers, namely the WRs and BURs are part of the 4-hi stand rolling mill.

The term "Strip/Work piece" refers to the metal sheet being produced.

The term "Roll Gap" refers to the gap between the pair of WRs, through which, the sheet is being produced.

The term "Material Properties" ($c_m$) refers to properties of the strip.

The term "Hydraulic Gap Control (HGC) Time Constant" ($\tau_{hyd}$) refers to the time constant of the controller for the roll gap. With regard to the base reference 4 high mill, hydraulic actuation applies the force onto the rollers.

The term "WR main drive constant" ($\tau_{roll}$) refers to the drive constant of the speed controller for the WRs.

The term "Reference angular velocity" ($\omega_{WR}$) refers to the reference angular velocity which is computed according to the set point WR speed.

The term "Diameter of BUR" ($D_{BUR}$) refers to the diameter of the BUR.

The following parameters describe the sensors monitoring the state or condition of the mill.

The term "Entry thickness" (h_1) refers to the thickness/height profile of a strip while entering the roll gap.

The term "Exit thickness" (h_2) refers to the thickness/height profile of a strip exiting the roll gap.

The term "WR angular velocity" ($\omega_{WR}$) refers to the angular velocities of the WRs (top and bottom).

The term "BUR angular velocity" ($\omega_{BUR}$) refers to the angular velocities of BURs, wherein the top and bottom speeds are measured as N1 and N2, respectively, and are used to determine ($\omega_{BUR}$).

The term "Roll Force" (F_roll) refers to the force that is applied on the rolls.

The term "Avg_gap" refers to the average gap between the WRs across its length.

The following parameter describe the actively controlled action on the mill.

The term "screw position" (S) refers to the screw position which is actively controlled to adjust the roll gap.

The following parameters are preset/predetermined before mill operations:

The term "Strip speed" ($v_{strip}$) refers to the speed of the strip exiting the roll gap.

The term "Mill speed" refers to the mill speed that is set by the mill operator and which is translated to the WR angular velocity.

The term "Mill Stretch" ($c_g$) refers to stretch that the 4 high-mill stand undergoes during mill operations.

The term "Material Modulus" ($c_m$) refers to the bulk modulus of the metal strip being produced.

The term "Reference Screw Position" ($S_{ref}$) refers to the screw position set at the start of mill operations.

The term "Reference WR angular velocity" ($\omega_{WRref}$) refers to the angular velocities of the WRs at the start of mill operations.

The following parameters are the system uncertainties that are estimated and compensated:

The term "Eccentricity" (e) refers to the eccentricity in the circumference of the large BURs that leads to errors/deviations in the strip thickness.

The term "Amplitude of roll eccentricity" ($a_{ecc}$=[$a_t$ $a_b$]) refers to the eccentricity over the BURs.

The term "Roll Slip" refers to the difference in the speeds between the top and bottom WR.

The term "Roll Gap" refers to the end effect roll gap achieved resulting from the controlled screw position change is uncertain due to variations in the strip properties, mill stretch, roll force, and eccentricities.

FIG. 1 illustrates a metal rolling mill system 2 with thickness control. An example is the METALSMASTER process from Honeywell International, Inc. which is modified to include the inventive embodiments. A rolling mill stand may include four or more rolls mounted vertically, such as, two smaller diameter work rolls, each in contact with separately mounted larger-diameter back-up rolls.

Incoming metal strip 18 of thickness H is provided by a roll 16 of material that is reduced to a thickness h through a multiplicity of rolls 4, 12, 14, 8 that consists of top back up roll 4, top work roll 12, bottom work roll 14, and bottom back up roll 8 (which are referred to collectively as a 4-hi stand 30). The metal strip 18 may be ferrous and/or non-ferrous. Strip 20 which exits from stand 30 is collected by a roll 22. Proximity sensor 6 measures the rotational position of top BUR 4 and proximity sensor 10 measures the rotational position of the bottom BUR 8. For load signal sampling, rotation around the roll circumference may be divided into a number of segments, such as 32 segments. These rotational positions are used to compute the angular velocities of the two BURs 4,8, which are part of the mill state parameters. A feature of the invention is to measure the angular velocity of the back up rolls Various conventional devices can be employed. Proximity sensors can be used. Representative proximity sensors include the series IGMF/INFW inductive proximity switches made by EGE-Electronik Spezial Sensoren GmbH (Gettorf, DE). BUR 4,8 angular velocity may be assumed to be the same as the work roll's 12, 14 angular velocity. Alternatively, the top and bottom work rolls 12, 14 may also be equipped with proximity sensors (not shown) to measure their actual angular velocities.

The stand 30 is equipped with a gap positioning system 26, which may be mechanical, hydraulic, or a combination of both, and is controlled by a feedback device 28. The gap positioning system 26, which can vary the work roll gap or opening, includes a pair of screwdown motors each equipped with a screwdown or screw which clamps against opposite ends of the two BURs 4, 8 and thereby apply pressure (roll force) to the work rolls 12, 14. The strip 20 leaves the stand 30 at thickness h, which is measured by sensor 24, which may be an x-ray gauge. "L" is the stand 30 centerline. The control objective is to regulate this outgoing thickness h, such as, at a centerline, as closely as appropriate to a specified target thickness.

Figure 2:
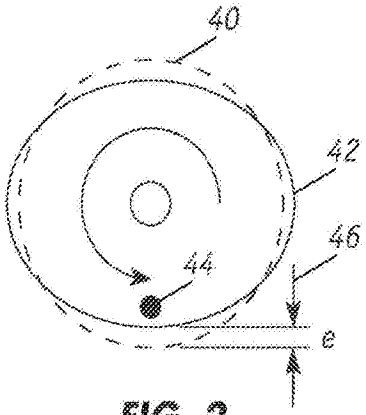
FIG. 2 is a schematic representation of an ideal and actual roll superimposed to illustrate eccentricity.

FIG. 2 is a schematic of eccentricity on a roll as an actual roll shape shown by solid line 42 and an ideal roll shape as shown by broken line 40 which are effectively coaxial. The amount of eccentricity is shown at a maximum eccentricity, e, at 46 as a difference between the ideal and actual radius. A proximity sensor 44 is positioned within a bottom BUR 14 from FIG. 1. The effect of eccentricity on thickness in a rolling application may be described as follows: Normally, an increased force means the exit thickness has increased (thus pushing the rolls apart). However, if the rolls are eccentric then when the largest radius passes through the roll gap, the force increases, but the exit thickness actually decreases. Hence, a change in force is misinterpreted when eccentricity components are present.

Thickness variations not directly related to roll eccentricity may be compensated separately. Pressure distributions from top 12 and bottom 14 work rolls may vary at nominal neutral position due to other reasons, such as roll bending with roll torque.

Mill stretch coefficient may be compensated in a mill-stand model. An HGC (hydraulic gap control) model may account for mill stretch, which is a non-linear function of rolling force.

A main drive model, including a series of non-linear ordinary differential equations, may be used to model main drive dynamics.

Deformation resistance may be based on a Bland, Ford, and Ellis model for roll force in cold strip rolling with tensions.

Damping coefficients and spring constants may be tuned.

Compensation may be included for roll slips, including forward slips, such as, by using roll gap control. The upper and lower work rolls may be subject to roll slips, such as due to variability in friction, so they may rotate at different speeds. This complicates the task of reducing variation in gauge of the strip being cold rolled. A slip factor variable may include a change in velocity between the work rolls and backup rolls. The slip factor may be exposed as a user tunable option.

The inventive Roll Eccentricity Compensation (REC) model uses real time/dynamic feedback for dynamic generation of an eccentricity signal with the aid of EKF to account for communication delays in feedbacks and process noise of mill operations. This involves a correlation and learning of the existing thickness deviation, the effective force and the manifested roll gap, into the model that generates an initial estimate of the eccentricity signal over the circumference of the Back Up Rolls. This is refined for real time identification of an eccentricity compensation signal which is suitable for the current state of mill operations.

With the present invention, proximity sensors 6, 10 are employed to track the BURs' 4, 8 angular position. Direct control concept—The method Eccentricity information is identified from the roll force and dynamic state identification and estimation. The theoretical model is described in the following Sections 1 through 9.

Section 1. Definitions

Work Roll (WR): Reference angular velocity from rotary encoder $\{\omega_{WR}\}$ Back Up Roll (BUR): Diameter for top & bottom BUR $\{\text{Diameter}_{BUR}\}$ Strip/Work Piece: Material Properties $\{c_m\}$ Roll Gap: Hydraulic Gap Control (HGC) time constant $\{\tau_{hyd}\}$ WR main drive constant $\{\tau_{roll}\}$ Section 2. Measurements State Observers Thickness/Height Profile of Strip Entry thickness $\{h_1\}$—measures the thickness of the strip before entering the work roll gap. An x-ray gauge can be employed.

Exit thickness $\{h_2\}$—measures the thickness of the strip after exiting the work roll gap.

Angular velocities/Rotational Speeds

WR angular velocity $\{\omega_{WR}\}$—This velocity can be determined with a proximity sensor that measures the rotational position and, hence, derives the angular velocity.

BUR angular velocity $\{\omega_{BUR}\}$—This velocity can be determined with a proximity sensor.

Roll Force $\{F_{roll}\}$—Pressure is applied by changing the screw position of the hydraulic press to the work rolls typically in response to feedback.

3. Active Control Variables

Screw Position to adjust roll gap {S}

4. System Presets/Constant Parameters

Strip speed $\{v_{strip}\}$)
Mill speed (or) WR angular velocity $\{\omega_{WR}\}$
Mill Stretch $\{c_g\}$
Material Modulus $\{c_m\}$
Reference Screw Position $\{S_{ref}\}$
Reference WR angular velocity $\{\omega_{WRref}\}$ Section 5. System Uncertainties Roll eccentricity
Eccentricity {e}
Amplitude of roll eccentricity $\{(a_{ecc}=[a_t\ a_b]\}$
Each for top and bottom BUR Section 6. Mathematical Models The following assumptions may be made as appropriate:

6.1 HGC Dynamics

Assume a first order system $$\left\{\frac{1}{\tau_{hyd}s+1}\right\}$$

Let this be $$\Delta S = S_{ref} - S$$

6.2 Main Drive Dynamics

Assume a first order system $$\left\{\frac{1}{\tau_{roll}s+1}\right\}$$

Let this be $$\Delta\omega_{WR} = \omega_{WR_{ref}} - \omega_{WR}$$

6.3 Estimate of Roll Force $$F_{roll} = \text{function}(h_2, S, e) \text{ or function}(c_m, h_1)$$

$$F_{roll} = c_g(h_2 - S + e)$$

$$F_{roll} = c_m(h_1 - h_2)$$

6.4 Estimate of Exit Thickness $h_2$=function ($c_g$, $c_m$, $h_1$, S, e)

Assume $$c_g(h_2 - S + e) = c_m(h_1 - h_2)$$

Then, $$h_2 = \frac{c_m h_1}{c_m + c_g} + \frac{c_g S}{c_m + c_g} - \frac{c_g e}{c_m + cg}$$

Assume, that there is no effect of $c_m$ and $c_g$ on entry thickness, $h_1$

Then, $$h_2 = \frac{c_g S}{c_m + c_g} - \frac{c_g e}{c_m + cg}$$

6.5 Estimate Screw Compensation Signal

From, $$F_{roll} = c_g(h_2 - S + e)$$

Partial derivative of roll force w.r.t. exit thickness:

$$\frac{\partial F_{roll}}{\partial h_2} = c_g - c_g\frac{\partial S}{\partial h_2}$$

substituting, $F_{roll}$=−$c_m$ $$\frac{\partial S}{\partial h_2} = 1 + \frac{c_m}{c_g}$$

Screw Compensation is, $$\Delta S = \frac{\partial S}{\partial h_2}h_2 = \left(1 + \frac{c_m}{c_g}\right)h_2$$

6.6 Estimate of Eccentricity Signal

Roll eccentricity is a periodic function that captures deformations on the BUR circum-surface. This periodic signal will change its properties with new work piece, WR angular velocity, roll force, and mill stretch.

Assume, $$e(t) = \sum_{j=1}^{H}\sum_{i=1}^{N} a_{ij}\sin(j\omega_i t)$$

Where, e(t)→eccentricity signal

N→no. of sine components

H→no. of harmonics of each sine component $a_{ij}$→Amplitude of $j^{th}$ sine component i $\omega_i$→Frequency of sine component i t→absolute time Here, a single sine component is $$e(t)=a\ \sin(\omega t)$$

Let $\phi=\omega t$

Then, the derivatives are:

$\dot{\phi}=\omega$ $\dot{\omega}=0$ $\dot{a}=0$

Let there be two components of eccentricity, each for top and bottom BUR

Then, we have:

$$e(t) = a_t\sin\phi_t + a_b\sin\phi_b$$

Where,

Top BUR→$\phi_t$, $\omega_t$, $a_t$

Bottom BUR→$\phi_b$, $\omega_b$, $a_b$

Then, the derivatives are:

$\dot{\phi}_t=\omega_t$ $\dot{\omega}_t=0$ $\dot{a}_t=0$ $\dot{\phi}_b=\omega_b$ $\dot{\omega}_b=0$ $\dot{a}_b=0$ Given the non-linear profile, an Extended Kalman Filter (EKF) is chosen for state estimation.

The Extended Kalman Filter may be based on statistical inference.

Section 7. State Space Representation of the Mathematical Model

7.1 State Space Representations $$\begin{bmatrix} h_2 \\ F_{roll} \end{bmatrix} = \begin{bmatrix} \frac{c_g}{c_m + c_g} & 0 \\ -\frac{c_g c_m}{c_g + c_m} & 0 \end{bmatrix} \begin{bmatrix} S \\ \omega_{WR} \end{bmatrix} + \begin{bmatrix} -\frac{c_g}{c_m + c_g} \\ \frac{c_g c_m}{c_m + c_g} \end{bmatrix} e(t)$$

$$\begin{bmatrix} \dot{S} \\ \dot{\omega}_{WR} \end{bmatrix} = \begin{bmatrix} -1 & 0 \\ 0 & -1 \end{bmatrix} \begin{bmatrix} S \\ \omega_{WR} \end{bmatrix} + \begin{bmatrix} 1 & 0 \\ 0 & 1 \end{bmatrix} \begin{bmatrix} S_{ref} \\ \omega_{WR_{ref}} \end{bmatrix}$$

where,

-continued $$e(t) \rightarrow \begin{bmatrix} \dot{\phi}_t \\ \dot{\omega}_t \\ \dot{a}_t \\ \dot{\phi}_b \\ \dot{\omega}_b \\ \dot{a}_b \end{bmatrix} = \begin{bmatrix} 0 & 1 & 0 & 0 & 0 & 0 \\ 0 & 0 & 0 & 0 & 0 & 0 \\ 0 & 0 & 0 & 0 & 0 & 0 \\ 0 & 0 & 0 & 0 & 1 & 0 \\ 0 & 0 & 0 & 0 & 0 & 0 \\ 0 & 0 & 0 & 0 & 0 & 0 \end{bmatrix} \begin{bmatrix} \phi_t \\ \omega_t \\ a_t \\ \phi_b \\ \omega_b \\ a_b \end{bmatrix}$$

From the above, we construct:

State Transition Model $$[\dot{X} = AX + BU]\text{–by convention}$$

A—state transition matrix $$\begin{matrix} -1/\tau_{hvd} & 1/\tau_{hvd} & 0 & 0 & 0 & 0 & 0 & 0 & 0 & 0 & 0 \\ 0 & 0 & 0 & 0 & 0 & 0 & 0 & 0 & 0 & 0 & 0 \\ 0 & 0 & -1/\tau_{roll} & 1/\tau_{roll} & 0 & 0 & 0 & 0 & 0 & 0 & 0 \\ 0 & 0 & 0 & 0 & 0 & 0 & 0 & 0 & 0 & 0 & 0 \\ 0 & 0 & 0 & 0 & 0 & 0 & 0 & 0 & 0 & 0 & 0 \\ 0 & 0 & 0 & 0 & 0 & \frac{\omega_t}{2\Pi} & 0 & 0 & 0 & 0 & 0 \\ 0 & 0 & 0 & 0 & 0 & 0 & \omega_t & 0 & 0 & 0 & 0 \\ 0 & 0 & 0 & 0 & 0 & 0 & 0 & 0 & 0 & 0 & 0 \\ 0 & 0 & 0 & 0 & 0 & 0 & 0 & 0 & \frac{\omega_b}{2\Pi} & 0 & 0 \\ 0 & 0 & 0 & 0 & 0 & 0 & 0 & 0 & 0 & \omega_t & 0 \\ 0 & 0 & 0 & 0 & 0 & 0 & 0 & 0 & 0 & 0 & 0 \end{matrix}$$

X—States

| | |
|---|---|
| S | screw position |
| $S_{ref}$ | reference screw position |
| $\omega_{WR}$ | angular velocity of WR |
| $\omega_{WR_{ref}}$ | reference angular velocity of WR |
| F | initial rotation at the start of coil roll |
| $\Omega_t$ | angular frequency of top BUR |
| $\omega_t$ | angular velocity of top BUR |
| $\alpha_t$ | amplitude of top BUR |
| $\Omega_b$ | angular frequency of bottom BUR |
| $\omega_b$ | angular velocity of bottom BUR |
| $\alpha_b$ | amplitude of bottom BUR |

The profile of eccentricity is filtered out by a complementary method using feedback from roll gap and roll force. The amplitude is scaled to millimeters to meet the compensation value for thickness correction. This correction which is calculated will be added as a sum component to Average Gap Output.

Figure 3:
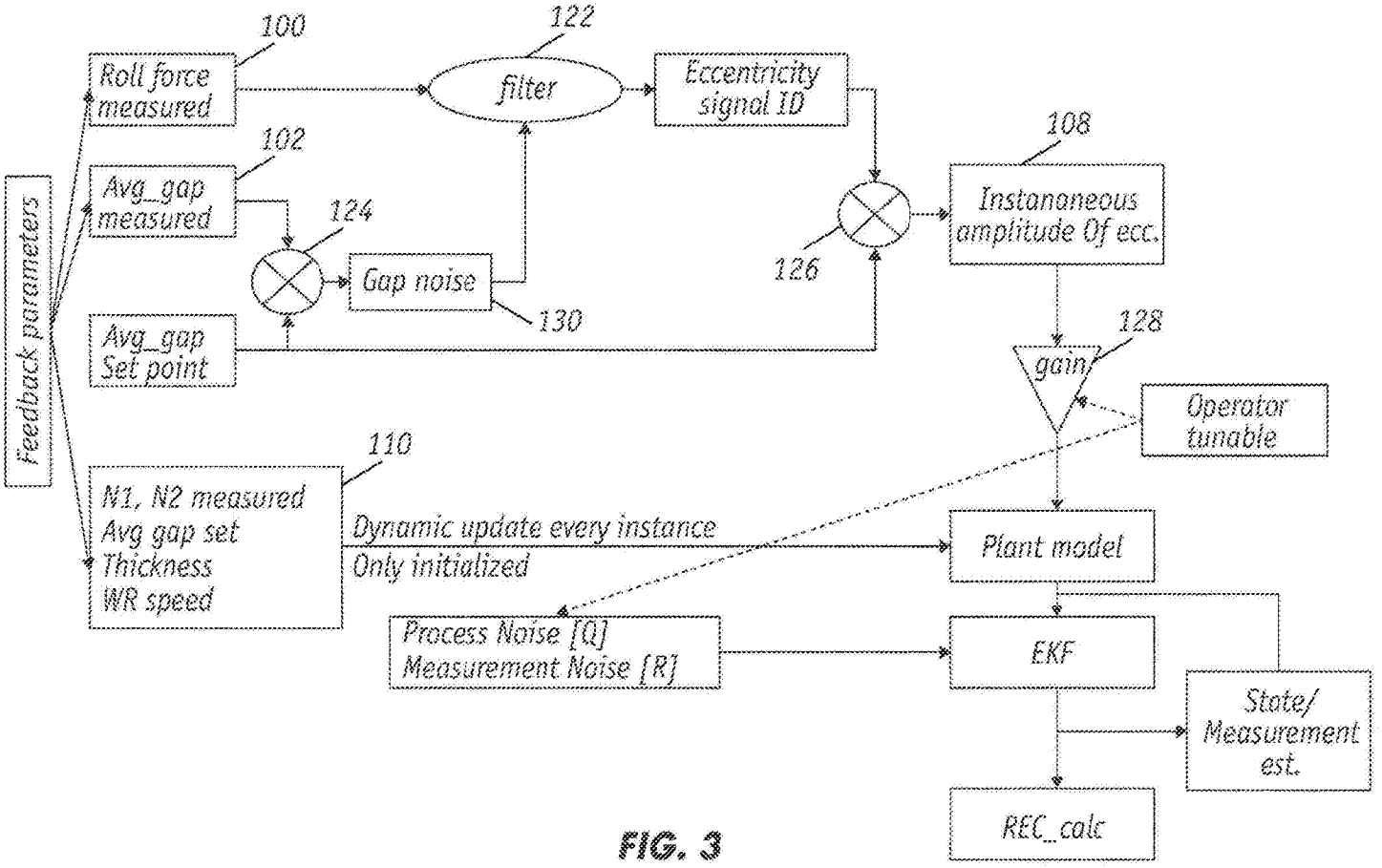
FIG. 3 is a flowchart that depicts operation of a control technique for a cold rolling mill (plant model)

FIG. 3 is a control schematic which describes the process of identifying of the roll eccentricity during a cold rolling mill run-time. The 'roll force,' 'average gap,' and angular velocities of the two BURs (N1 and N2) are measured in steps 100, 102 and 110. These contribute to the dynamic partial state feedback for the entire system. Step 124 determines if there is a difference between the measured average roll gap and the set roll gap and, if so, the calculation is used to estimate an effective gap that is noisy, called 'gap noise' 130. This is used to identify the effective 'roll force' in step 100 that is filtered using 'gap noise' in step 122. Meanwhile, an instantaneous amplitude of eccentricity is extracted from the instant in the waveform of the eccentricity signal in steps 126, 108. As an option, instantaneous data depicting the waveform of the eccentricity signal may be extracted by the operator at any time for further exploration of the mill status such as for maintenance and efficiency. The estimated amplitude of eccentricity corresponds to the deviation in the 'roll gap' that needs to be corrected. This amplitude of eccentricity may be scaled up, or scaled down, by the operator, to accommodate other uncertainties in the mill, as defined by a gain constant, which, by default, may equal to 1 in step 128.

Section 8. Operator Tunable Parameters

The inventive method also allows tunability of various parameters appropriate for the rolling mill site. These parameters are accessible any time by the operators and may be employed to scale the eccentricity amplitude for further improvement. The tuning may be required only to troubleshoot operational issues. These parameters include, for example:

Radius of top and bottom, WR and BUR.

Mill Stretch $\{c_g\}$.

Material Modulus $\{c_m\}$.

Eccentricity amplitude scaling.

Number of harmonics.

Execution rate.

Power Spectral Density (PSD) constants for process noise (q) and measurement noise (r): q_s, q_v, q_h, q_a, q_f, r_s, r_v, r_h, r_f PSD constants are generic mathematical concepts which support noise functions. They can be tuned by the mill operator.

Section 9. Description of Method

Figure 4:
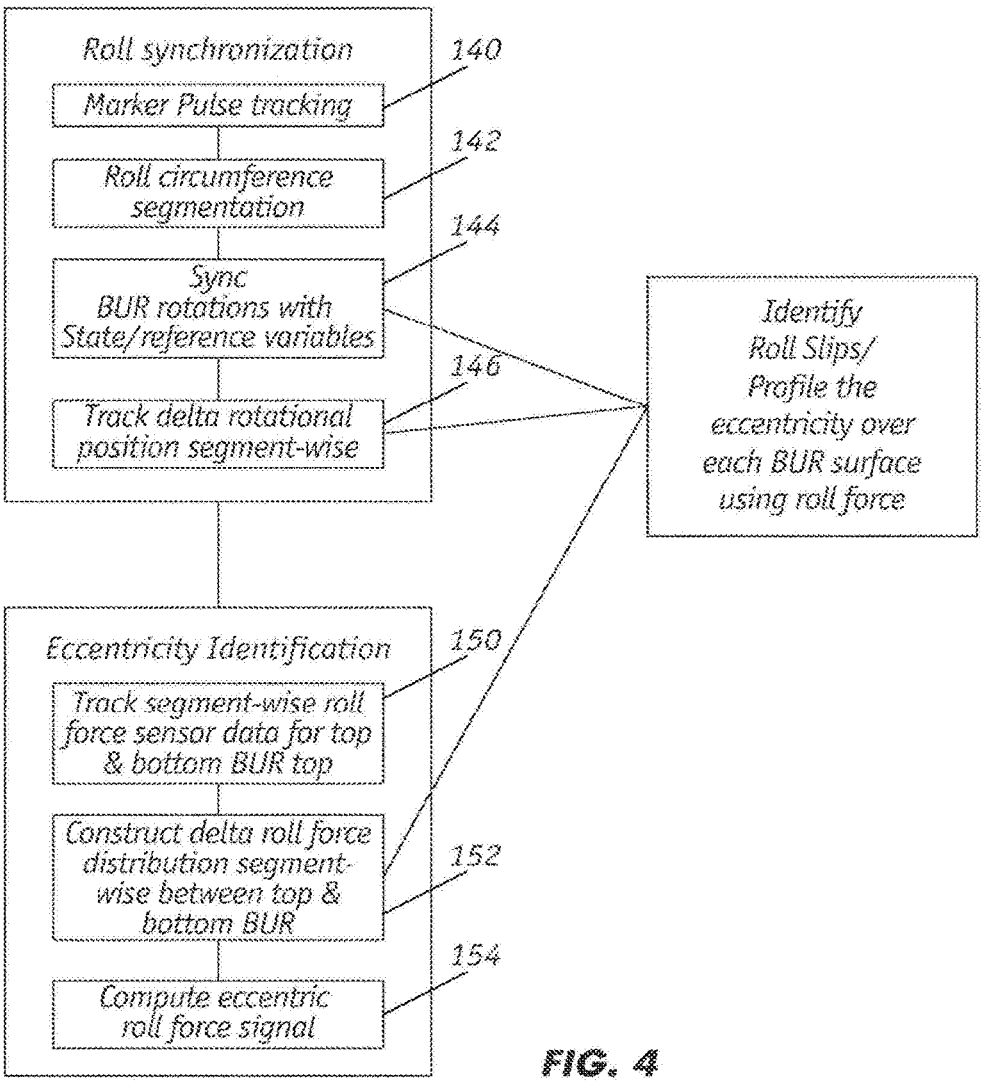
FIG. 4 is a flowchart that describes a state of identification method with respect to roll speeds, its synchronization, and roll eccentricity.

FIG. 4 lists the roll synchronization and eccentricity identification steps for the inventive sensor and EKF-based roll eccentricity and compensation technique.

Roll synchronization begins with process step 140 which includes marker pulse tracking.

After process step 140, the next process step 142 includes roll circumference segmentation.

After process step 142, the next process step 144 includes Sync BUR rotations with state/reference variables.

After process step 144, the next process step 146 includes track delta rotational position segment-wise.

Process step 146 completes roll synchronization which is then followed by eccentricity identification which begins with process step 150 which includes track segment-wise roll force sensor data for top and bottom BUR.

After process step 150, the next process step 152 includes construct delta roll force distribution segment-wise between top and bottom BUR.

After process step 152, the next process step 154 includes compute eccentric roll force signal.

Process step 154 completes eccentricity identification.

Process steps 144, 146, and 152 also identify roll slips/profile the eccentricity over each BUR surface using roll force.

Figure 5:
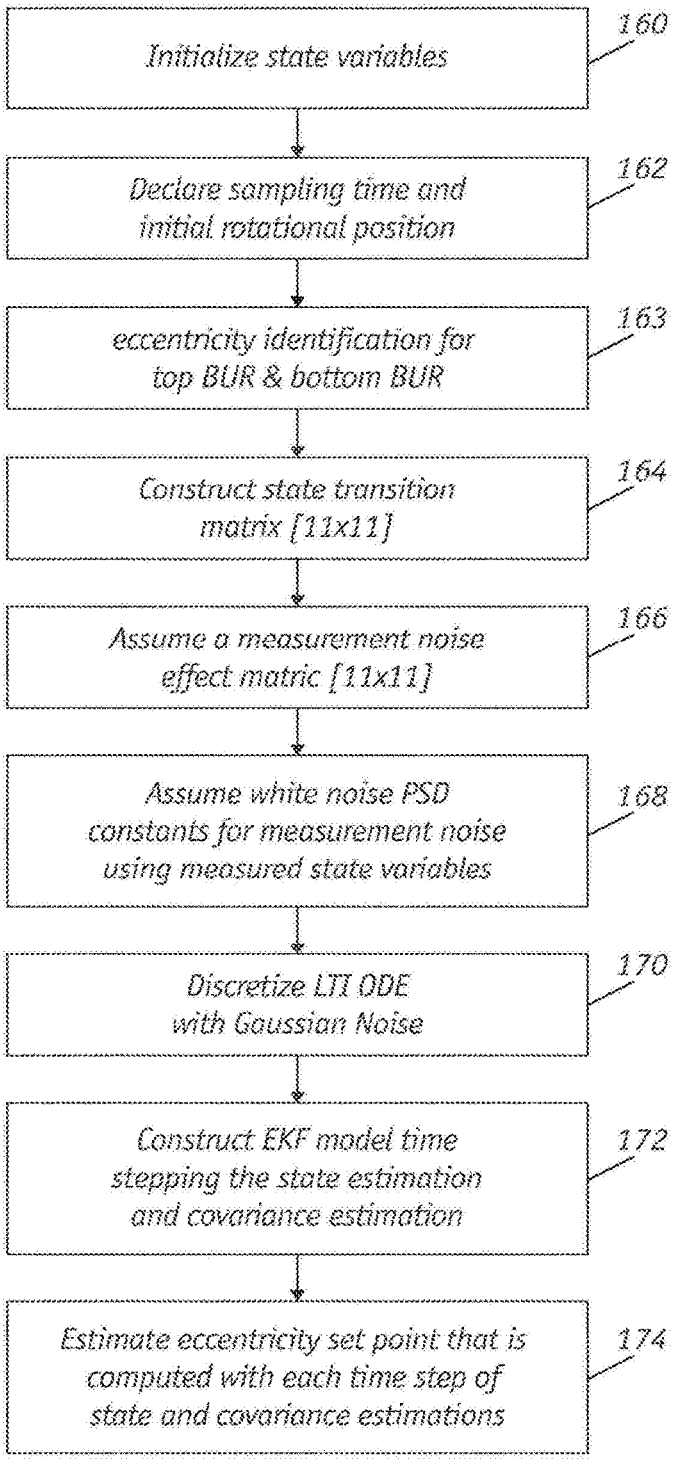
FIG. 5 is a flowchart describing a method of estimating state or condition of a mill with sensor feedback using Extended Kalman Filter for operation of a cold rolling mill (plant model) as shown in FIG. 1.

FIG. 5 shows the organization of the overall method, such as, in a MATLAB/software/firmware implementation.

Process step 160 begins with initialize state variables.

After process step 160, the next process step 162 includes declare sampling time and initial rotational position.

After process step 162, the next process step 163 includes eccentricity identification for top BUR & bottom BUR.

After process step 163, the next process step 164 includes construct state transition matrix [11×11].

After process step 164, the next process step 166 includes assume a measurement noise effect matrix [11×11].

After process step 166, the next process step 168 includes assume white noise PSD constants for measurement noise using measured state variables.

After process state 168, the next process state 170 includes discretize LTI ODE with Gaussian noise.

After process step 170, the next process state 172 includes construct EKF model time stepping the state estimation and covariance estimation.

After process step 172, the next process step 174 includes estimate eccentricity set point that is computed with each time step of state and covariance estimations.

Figure 6:
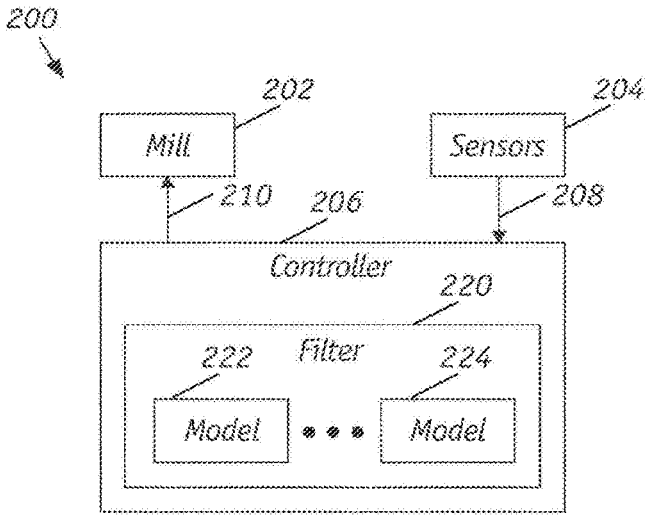
FIG. 6 illustrates a rolled sheet metal system for sensing and controlling sheet metal thickness.

The inventive process may be incorporated into a plant, such as, a cold rolling mill system 200, including those with automatic gauge control (AGC) and hydraulic gap control (HGC) controllers to improve the thickness accuracy of sheets produced. As shown in FIG. 6, a mill 202 may include output 210 from a controller 20. The output 210 may include roll eccentricity compensation, such as, is described in US 2018/0161839 to McGahan, which is incorporated herein by reference. The controller 206 may include input 208 from sensors 204, such as, for top and bottom BURs. The controller 206 may include a filter 220. The filter 220 may include various models 222, 224 by integration of an inventive method, such as, in a MATLAB script or in another suitable program into the controller environment. The model 222 may include state estimation and covariance (noise effect) estimation. The model 224 may include a state transition model with dynamic partial state feedback.

The inventive method may be implemented and validated in HTS lab simulation environment, for various cases of preset conditions. In an embodiment of the present invention, it showed an improvement of up to 10%, over the existing range of 0.5-1.5% thickness deviation. In another embodiment of the present invention, the thickness accuracy improved by an additional 10% over that of an AGC controller's performance.

1. The eccentricity estimation adapts to the actual eccentricity changes in the rolling mill over time.

2. Allows the operator to scale the eccentricity amplitude for further improvement.

3. The noise model assumed in the plant process and measurements are operator tunable for Power Spectral Density (PSD) constants for further improvement.

Figure 7:
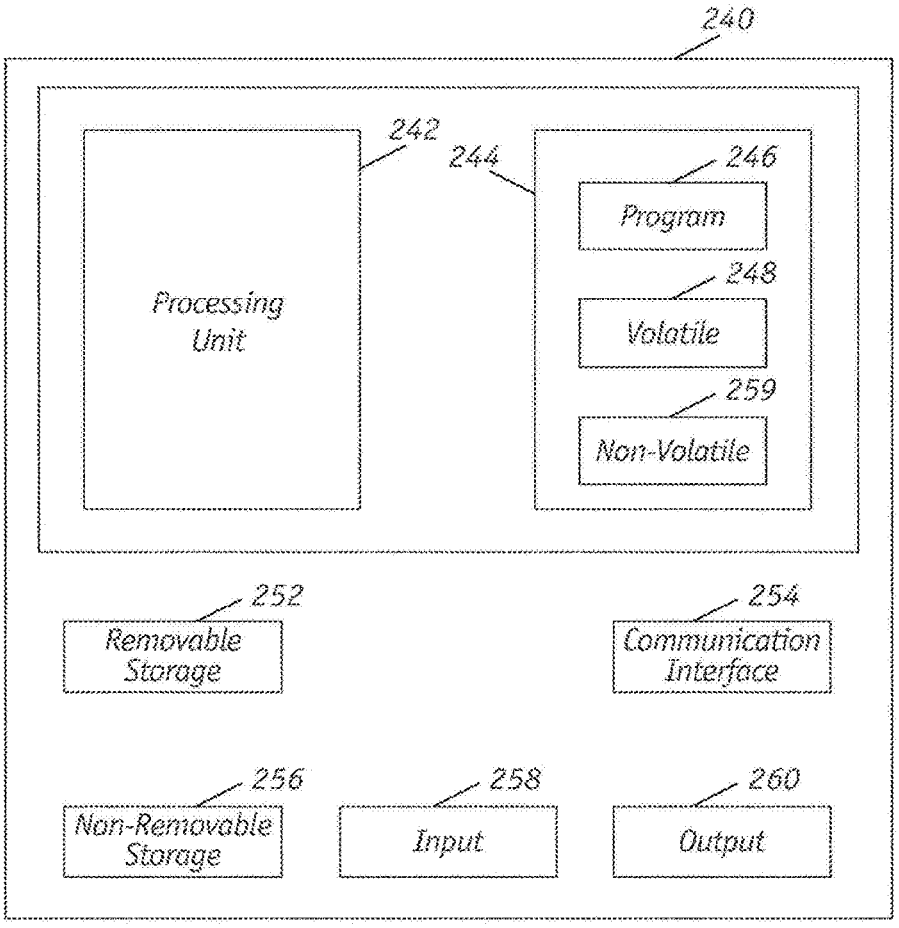
FIG. 7 illustrates a computer system to implement a controller.

FIG. 7 is a block schematic diagram of computer system 240 to implement the controller and methods according to example embodiments. Not all components need to be used in various embodiments One example computing device in the form of a computer system 240, may include processing unit 242, memory 244, removable storage 252, and non-removable storage 256. Although the example computing device is illustrated and described as computer system 240, the computing device may be in different forms in different embodiments. For example, the computing device may instead be a smartphone, a tablet, a smartwatch, or other computing device including the same or similar elements as illustrated and described with regard to FIG. 7. Devices such as smartphones, tablets, and smartwatches are generally collectively referred to as mobile devices. Furthermore, although the various data storage elements are illustrated as part of computer system 240, the storage may also, or alternatively, include cloud-based storage accessible via a network, such as the Internet.

Memory 244 may include volatile memory 248 and non-volatile memory 259. Computer system 240 may include—or have access to a computing environment that includes—a variety of computer-readable media, such as volatile memory 248 and non-volatile memory 259, removable storage 252 and non-removable storage 256. Computer storage includes random access memory (RAM), read only memory (ROM), erasable programmable read-only memory (EPROM) & electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage, or other magnetic storage devices capable of storing computer-readable instructions for execution to perform functions described herein.

Computer system 240 may include, or have access to, a computing environment that includes input 258, output 260, and a communication interface 254. The output 260 may include a display device, such as a touchscreen, that also may serve as an input device. The input 258 may include one or more of a touchscreen, touchpad, mouse, keyboard, camera, one or more device-specific buttons, one or more sensors integrated within, or coupled via, wired or wireless data connections to computer system 240, and other input devices. The computer may operate in a networked environment using a communication connection to connect to one or more remote computers, such as database servers, including cloud-based servers and storage. The remote computer may include a personal computer (PC), server, router, network PC, a peer device or other common network node, or the like. The communication connection may include a Local Area Network (LAN), a Wide Area Network (WAN), cellular, WiFi, Bluetooth, or other networks.

Computer-readable instructions stored on a computer-readable storage device are executable by the processing unit 242 of the computer system 240. A hard drive. CD-ROM, and RAM are some examples of articles including a non-transitory computer-readable medium such as a storage device. The terms computer-readable medium and storage device do not include carrier waves. For example, a computer program 246 may be used to cause processing unit 242 to perform one or more methods or algorithms described herein.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A controller for controlling thickness of sheet metal in a rolling mill exiting a rolling mill stand, the rolling mill stand comprising:

a first work roll and a second work roll respectively positioned between a first back up roll and a second back up roll, the controller comprising a processor and code stored on media readable by the processor to control the thickness of the sheet metal, the processor is configured to:

receive an input comprising at least a plurality of parameters associated with the thickness of the sheet metal and the rolling mill stand;

generate a model of the rolling mill stand based on the plurality of parameters;

estimate, using the model, an eccentricity in the rolling mill stand based on a feedback input from the rolling mill stand in run time, wherein the feedback input comprises at least angular velocities of the first back up roll and the second back up roll, a roll force, and an average gap between the first work roll and the second work roll;

estimate, by a filter, a state of the rolling mill stand based on at least the estimated eccentricity and the model of the rolling mill stand; and generate an output including a roll eccentricity compensation signal based on at least the estimated state of the rolling mill stand to control a gap between the first work roll and the second work roll for controlling the thickness of the sheet metal produced by the rolling mill stand.

2. The controller of claim 1, wherein the processor is further configured to:

determine roll slips between the first work roll and the second work roll in the rolling mill stand based on the estimated eccentricity.

3. The controller of claim 1, wherein the filter comprises an Extended Kalman Filter.

4. The controller of claim 1, wherein the controller is coupled to proximity sensors configured to measure rotational positions of the first back up roll and the second back up roll.

5. The controller of claim 1, wherein the plurality of parameters associated with the rolling mill stand comprises reference angular velocity from a rotary encoder, diameter of a first back up roll, diameter of a second back up roll, material properties, a roll gap or a Hydraulic Gap Control (HGC) time constant, a first and a second work roll main drive constant, a mill stretch, a material modulus, and a reference screw position.

6. The controller of claim 1, wherein to estimate the eccentricity in the rolling mill stand, the processor is further configured to:

determine if an average roll gap between the first work roll and the second work roll is equal to a set roll gap; and on determining a difference exists between the average roll gap and the set roll gap, determine the feedback input for estimating the eccentricity.

7. A method of programming a controller for controlling a thickness of a sheet metal produced by a rolling mill stand, the rolling mill stand comprising a first work roll and a second work roll respectively positioned between a first back up roll and a second back up roll, the method comprising:

receiving an input comprising at least a plurality of parameters associated with the thickness of the sheet metal and the rolling mill stand;

generating a model of the rolling mill stand based on the plurality of parameters;

estimating, using the model, an eccentricity in the rolling mill stand based on feedback input from the rolling mill stand in run time, wherein the feedback input comprises at least angular velocities of the first back up roll and the second back up roll, a roll force, and an average gap between the first work roll and the second work roll;

estimating, by a filter, a state of the rolling mill stand based on at least the estimated eccentricity and the model of the rolling mill stand; and generating an output including a roll eccentricity compensation signal based on at least the estimated state of the rolling mill stand to control a gap between the first work roll and the second work roll for controlling the thickness of the sheet metal produced by the rolling mill stand.

8. The method of claim 7, wherein the filter is an Extended Kalman Filter.

9. The method of claim 7, further comprising:

determining roll slips between the first work roll and the second work roll in the rolling mill stand based on the estimated eccentricity.

10. The method of claim 7, wherein estimating the eccentricity in the rolling mill stand, further comprises:

determining if an average roll gap between the first work roll and the second work roll is equal to a set roll gap; and on determining a difference exists between the average roll gap and the set roll gap, determining the feedback input for estimating the eccentricity.

11. A metal rolling mill system for controlling thickness of sheet metal, the metal rolling mill system comprising:

a rolling mill stand comprising a first work roll and a second work roll respectively positioned between a first back up roll and a second back up roll;

a processor;

one or more sensors configured to measure a plurality of parameters associated with the thickness of the sheet metal and the rolling mill stand; and a memory device coupled to the processor and comprising a readable program for execution by the processor to:

receive an input comprising the plurality of parameters from the one or more sensors;

generate a model of the rolling mill stand based on the plurality of parameters;

estimate, using the model, an eccentricity in the rolling mill stand based on feedback input measured from the rolling mill stand in run time, wherein the feedback input comprises at least angular velocities of the first back up roll and the second back up roll, a roll force, and an average gap between the first work roll and the second work roll;

estimate, by a filter, a state of the rolling mill stand based on at least the estimated eccentricity and the model of the rolling mill stand; and generate an output including a roll eccentricity compensation signal based on at least the estimated state of the rolling mill stand to control a roll gap between the first work roll and the second work roll for controlling the thickness of the sheet metal produced by the rolling mill stand.

12. The metal rolling mill system of claim 11, wherein the processor is further configured to calculate a roll slip value between the first and second work rolls in the rolling mill stand based on the estimated eccentricity.

13. The metal rolling mill system of claim 11, wherein the filter is an Extended Kalman Filter.

14. The metal rolling mill system of claim 13, wherein the angular velocities are determined by proximity sensors.

15. The metal rolling mill system of claim 11, wherein the plurality of parameters associated with the rolling mill stand comprises a reference angular velocity from a rotary encoder, a diameter of the first back up roll, a diameter of a second back up roll, material properties, a roll gap or a Hydraulic Gap Control (HGC) time constant, a first and a second work roll main drive constant, a mill stretch, a material modulus, and a reference screw position.

16. The metal rolling mill system of claim 11, wherein to estimate the eccentricity in the rolling mill stand, the processor is further configured to:

determine if an average roll gap between the first work roll and the second work roll is equal to a set roll gap; and on determining a difference exists between the average roll gap and the set roll gap, determine the feedback input for estimating the eccentricity.

* * * * *